United States Patent [19]

Patterson

[11] 4,251,963

[45] Feb. 24, 1981

[54] EARTH ANCHOR

[76] Inventor: Merle W. Patterson, 2635 E. 28th St., Tulsa, Okla. 74114

[21] Appl. No.: 80,534

[22] Filed: Oct. 1, 1979

Related U.S. Application Data

[63] Continuation-in-part of Ser. No. 857,781, Dec. 5, 1977.

[51] Int. Cl.[3] ..... E02D 5/74

[52] U.S. Cl. ..... 52/157; 52/161; 52/162

[58] Field of Search ..... 52/157, 160, 161, 162, 52/163, 164

[56] References Cited

U.S. PATENT DOCUMENTS

| | | | |
|---|---|---|---|
| 7,207 | 3/1850 | Bell | 114/311 |
| 129,878 | 7/1872 | Wilson | 114/311 |
| 289,224 | 11/1883 | Clark | 114/311 |
| 1,570,646 | 10/1951 | Cole | 52/160 |
| 1,807,488 | 5/1931 | Michalicek | 52/161 |
| 1,907,811 | 5/1933 | Hollos | 52/161 |
| 2,343,350 | 3/1944 | Warren | 52/161 |
| 2,905,288 | 9/1959 | Rande | 52/160 |
| 4,189,879 | 2/1980 | Patterson | 52/161 |

*Primary Examiner*—Price C. Faw, Jr.
*Assistant Examiner*—H. E. Raduazo
*Attorney, Agent, or Firm*—James H. Chafin

[57] ABSTRACT

An earth anchor for securing objects in soft earth and including a plurality of anchor arms which are extendable after the anchor is moved into position. A flexible, pleated, metal skirt member is attached to the anchor arms whereby after being augered into position, the anchor arms and skirt member may be extended into substantially undisturbed earth thereby providing an anchoring surface at least as great as the surface area of the skirt member.

9 Claims, 12 Drawing Figures

EARTH ANCHOR

CROSS-REFERENCE TO RELATED APPLICATION

This is a continuation-in-part application of copending application Ser. No. 857,781, filed Dec. 5, 1977 for "Earth Anchor".

BACKGROUND OF THE INVENTION

1. Field of the Invention

The present invention relates to earth anchors and more particularly, but not by way of limitation, to an earth anchor having extendable anchor arms and a metal skirt attached to the anchor arms which is particularly suited to anchoring objects in soft earth, swamp or marshlands.

2. History of the Prior Art

There have been many innovations in the development of earth anchors for supporting guy wires, anchoring mobile homes and the like. Many of these developments include anchors which have extendable arms and after insertion into an anchoring hole, these arms are extended into the surrounding earth to perform the anchoring function.

However, the prior art anchoring devices have not been totally successful for use in soft earth such as sand and around streams, rivers, lakes and oceans or in swamp or marshlands.

In the construction of pipelines across swamps and the like, the pipelines have been anchored by the sinking of large concrete weights having attachment cables for connecting the pipeline thereto. This method has the obvious disadvantage of requiring large swamp barges for the handling of the concrete blocks. The gradual sinking of these blocks due to their weight and the cost of the blocks and handling thereof cause the cost of laying such pipelines to be extremely high.

One of the primary reasons for the failure of earth anchors in such applications is that in order to make the anchor arms retract into a package small enough to be inserted into a small drilled hole, the anchor arms must be rather narrow. Once these narrow anchor arms are extended into the earth, they simply do not have sufficient cross-sectional area to provide the necessary holding power.

Further, in the use of retractable or extendable anchor arms, there has been a constant danger of the locking mechanism which holds the anchor arms into an extended position, becoming loose and thereby allowing the arms to inadvertently retract and loose their anchoring power.

There have been various screw-type activated anchors such as taught in the patent to Cole et al, U.S. Pat. No. 1,606,147, issued Nov. 9, 1926 for an "Earth Anchor Device" and the patent to Handel, U.S. Pat. No. 2,217,271, issued Oct. 8, 1940 for "Expansible Earth Anchor". However, these anchors have an inherent disadvantage in that the threaded rod used for expanding the anchor after expansion, is subject to exposure to the elements and becomes rusty or corroded. Since the threaded rod is often the mechanism which locks the arms in the extended position, corrosion will destroy the locking feature in a relatively short period of time.

A further disadvantage of the subject patent is the limitation on the surface area caused by the shape and size of the anchor arms in conjunction with the hole size into which they are to be inserted.

SUMMARY OF THE INVENTION

The present invention provides an earth anchor having an extendable anchoring mechanism and which can be positively locked in its extended position. The means for locking the mechanism in an extended position is fully protected from corrosion which naturally extends the expected life of the anchor when used in a corrosive environment.

The anchor generally comprises an elongated anchor rod having the inner end portion threaded over a specific length. A first plate member is slidably disposed on the threaded rod, the upper outer surface of the plate being in engagement with a flanged boss member which is rigidly connected to the rod for rotation therewith, said flange portion being utilized to force the plate member downwardly and expanding the anchor arms as will be hereinafter set forth.

A plurality of anchor arms are pivotally attached to the lower or inner surface of the plate member and extend downwardly and may be folded into a pattern no longer than the surface area of the plate member. A substantially cylindrical-shaped metal skirt member is pleated into a smaller cylindrical shape and attached to the outer surface of the anchor arms so that said anchor arms with their attached skirt members are initially folded in a cylindrical shape having diameter no greater than the plate member.

A second plate member is threadably disposed on the rod near the inner end of the rod and is of approximately the same diameter as the first mentioned plate member. The outer or upper surface of the second plate member is placed in engagement with the inner surface or ends of the anchor arms. A substantially conical or tapered housing is provided on the bottom or inner surface of the second plate member and is of a length substantially equal to the length of the threaded portion of the anchor rod for receiving the anchor rod therein.

The outer periphery of the conical-shaped housing is provided with a plurality of auger ribbon flights so that the entire anchor arm mechanism may be augered in soft earth without the requirement of having first drilled a hole in order to seat the anchor means.

It is noted that should a pre-drilled hole be used for seating this anchor, it would be unnecessary to have the auger ribbon flights around the outer periphery of the housing.

In the case where the auger ribbon flights are used however, there is a locking mechanism cooperating between the second plate member and the threaded rod in order to lock said members for simultaneous rotation during the augering operation in order to get the anchor to the desired depth.

After the device has been augered into its desired depth, the anchoring rod may be rotated in a reverse direction which disengages the locking mechanism and after that, rotation of the anchoring rod will cause the rod to threadably travel through the second plate member and into the housing thereby pushing the first plate member downwardly toward the second plate member which causes the anchoring arms to be expanded into the earth.

As the arms expand into the earth, the skirt member travels with the arms and opens to form an enlarged surface area to provide greater holding power for the anchor. The anchor arm mechanism is designed so that when the anchor arms are in their fully extended position, they extend slightly upward whereby the upper surface skirt member is concave. This is felt to provide better holding power.

In some cases where the consistency of the earth is something more solid than marshland or loose sand, some difficulty is encountered in expanding the anchor arms and associated skirt member when the outer surface of the anchor arms are configured substantially straight.

Therefore, the present invention includes embodiments wherein the outer surface of the anchor arms are curved to form a concave shape whereby upon extension into the earth, they will move through the surrounding earth in an arcuate path with a minimum amount of disturbance. In the expanded position the outer surface or upper surface of the skirt member will then form a more accented concave surface.

Another feature of all of the embodiments of the invention includes the fact that when the arms and skirt member are in the fully extended position, the inner edge of the skirt member will still be in a pleated condition. The design of the diameter of the plate members in conjunction with the inner edge of the skirt member are such that the first and second plate members, in the fully extended position tend to sandwich the inner edge of the skirt member therebetween to provide additional stability when a pulling force is applied to the anchor.

DESCRIPTION OF THE DRAWINGS

Other and further advantageous features of the present invention will hereinafter more fully appear in connection with a detailed description of the drawings in which.

DESCRIPTION OF THE PREFERRED EMBODIMENTS

Figure 1:
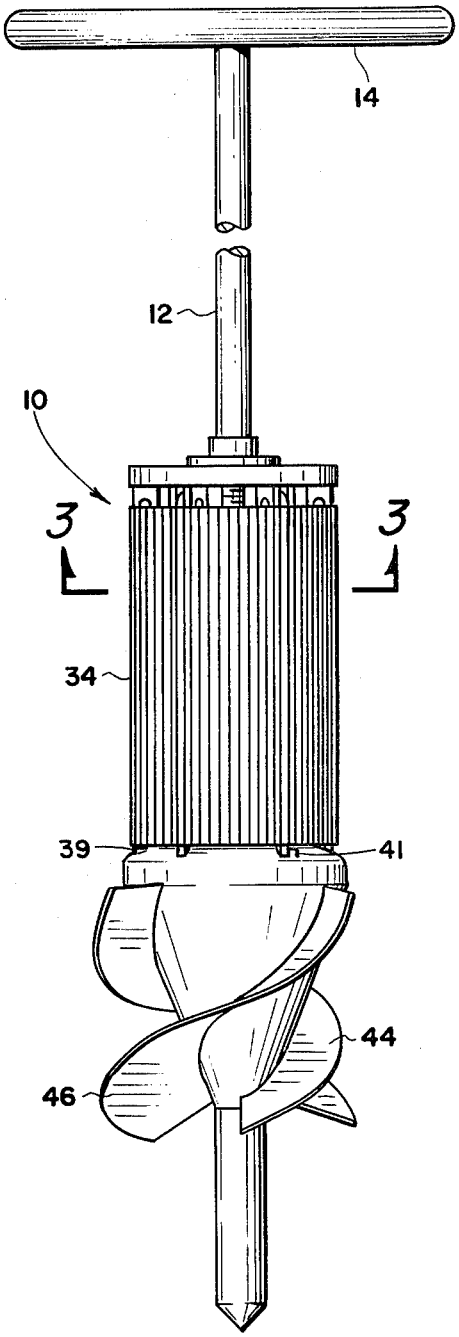
FIG. 1 is a side elevational view of an earth anchor embodying the present invention.

Referring to the drawings in detail and particularly to FIGS. 1 through 8, reference character 10 generally indicates an earth anchor which is particularly adaptable for use in anchoring objects in soft earth, sand, swamp or marshlands.

The anchor 10 generally comprises an elongated anchor rod 12, the outer end of which may be fitted with a suitable handle member 14 which, after seating the anchor, may be replaced by an anchor hook or other attachment device (not shown).

Figure 2:
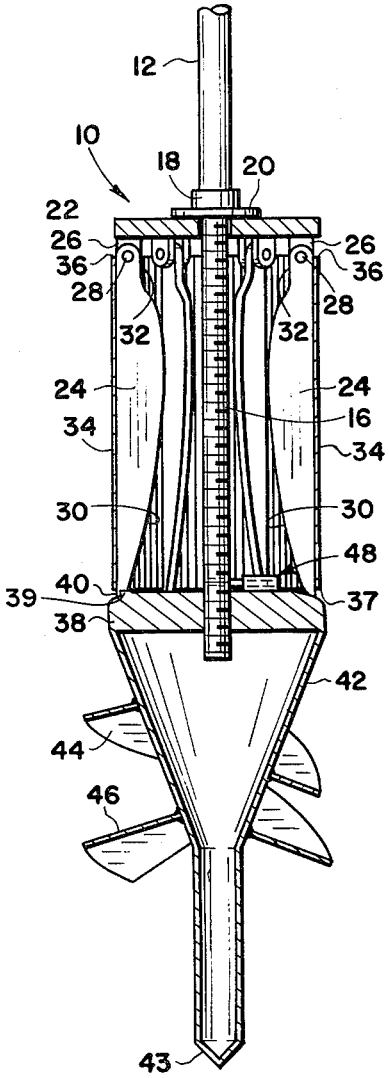
FIG. 2 is a sectional elevational view of the earth anchor of FIG. 1.
Figure 3:
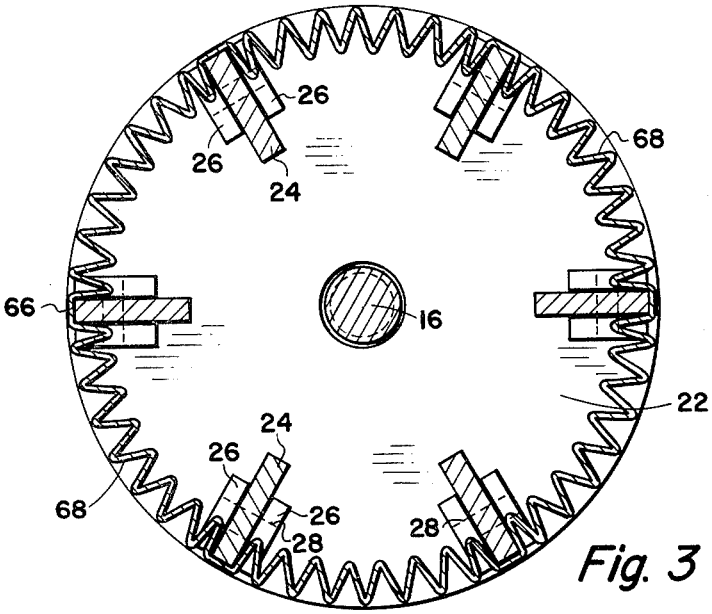
FIG. 3 is a sectional bottom view of the anchor of FIG. 1 taken along the broken lines 3—3 of FIG. 1.

The inner end portion of the anchor rod 12 is provided with an elongated threaded segment 16 as shown in FIG. 2. A collar member 18 is rigidly secured to the rod 12 near the outer end of the threaded portion 16 and is provided with an outwardly extending flange member 20 at the lower end thereof.

A first circular plate member 22 is slidably disposed on the threaded portion of 16 of the rod 12, the upper surface of the plate 22 being engagable with the lower surface of the flange member 20.

A plurality of elongated anchor arms 24 are pivotally secured to the lower surface of the plate member 22 by a suitable downwardly extending ear member 26 and associated pivot pins 28.

The anchor arms 24 have arcuate inside surfaces 30 which extend from the outer ends of the anchor arms toward the pivot pins 28 and terminating in a shaped land portion 32 for a purpose that will be hereinafter set forth.

A metal skirt member 34 having a circular cylindrical shape is pleated to form a smaller cylindrical shape having diameter approximately equal to the diameter of the plate member 22. The skirt member 34 in its pleated shape as shown in FIGS. 1 and 2 is rigidly secured to the outer surfaces of the anchor arms 24 as shown in FIG. 2.

The upper or inner edge 36 of the skirt member 34 extends at least as high as the pivot pins 28 for a purpose that will be hereinafter set forth.

A second circular plate member 38 is threadedly secured to the lower end of the threaded portion 16 of the rod 12. The upper outside edge of the plate member 28 is beveled at 40 and is initially disposed in contact with the arcuate surface 30 of the anchor arms 24 wherein said beveled portion 40 is substantially in contact with the outer ends of said anchor arms 24.

A plurality of upwardly extending anti-rotation stop members 39 and 41 are secured to the upper surface of the plate member 38 and are positioned adjacent the lower or outer ends of the arms 24 for a purpose that will hereinafter be set forth.

A substantially conical shaped housing member 42 is secured to the lower surface of the plate member 38, the upper end of said housing being in open communication with the lower end of the threaded portion 16 of the rod 12. The length of the housing 42 is substantially the same length as the threaded portion 16 of the rod 12 for receiving said threaded portion 16 fully inside the housing in a manner that will be hereinafter set forth. The lower end of the housing member 42 is pointed at 43 for easy insertion into the earth and the outer periphery of said housing is provided with one or more auger ribbons 44 and 46.

Figure 6:
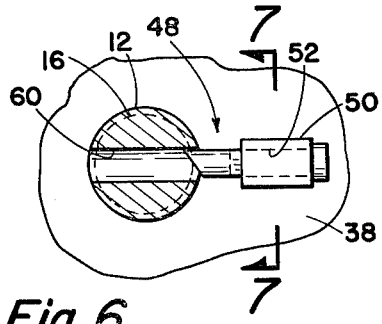
FIG. 6 is an end sectional view of a locking mechanism provided between the anchor rod and expanding plate of the embodiment of FIG. 1.
Figure 8:
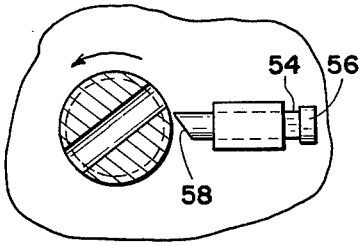
FIG. 8 is a plan sectional view of the locking mechanism of FIG. 6 shown in the second unlocked position.
Figure 7:
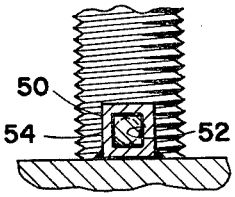
FIG. 7 is a sectional elevational view of the locking mechanism of FIG. 6 taken along the broken lines 7—7 of FIG. 6.
Figure 4:
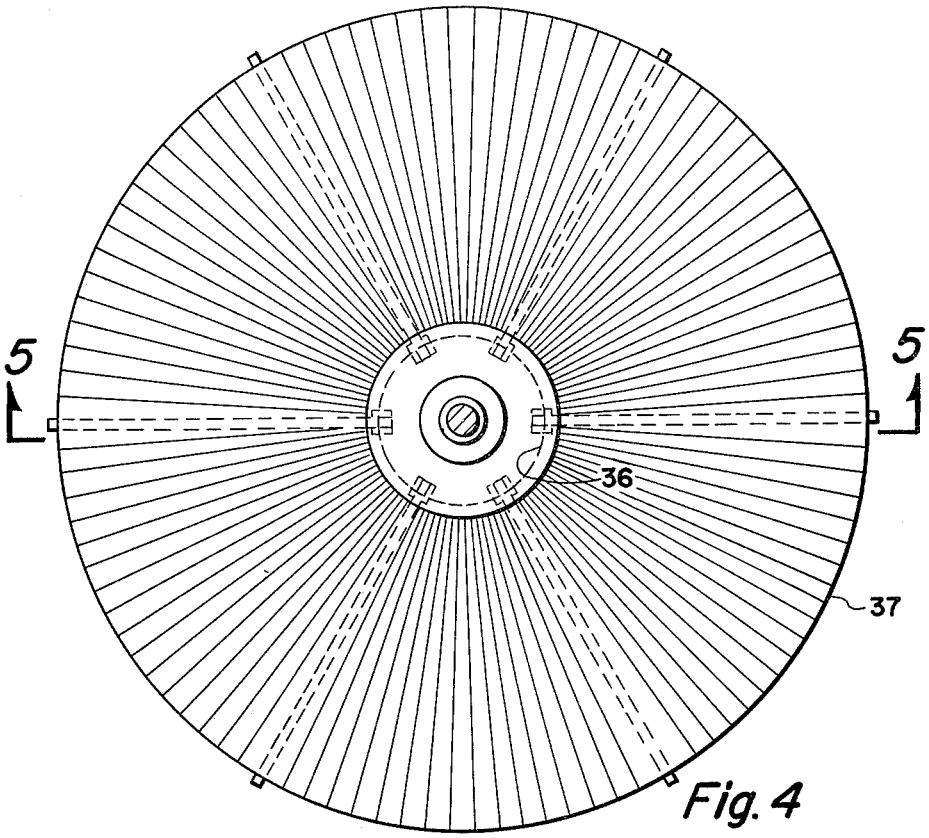
FIG. 4 is a plan view of the earth anchor of FIG. 1 in an expanded position.

A locking member generally indicated by reference character 48 is operably connected between the threaded portion 16 of the rod 12 and the upper surface of the plate member 38. Referring to FIGS. 6, 7 and 8, the locking mechanism 48 comprises a block member 50 which is rigidly secured to the upper surface of the plate 38 in a position near the threaded portion 16 of the rod 12.

The block member 50 is provided with a rectangular transverse aperture 52 for slidably carrying a pin member 54, also having a rectangular cross-sectional shape. The outer end of the pin member 54 is provided with a flange 56 to limit the travel of the pin member toward the threaded portion 16 of the rod 12. The inner end of the pin member 54 is provided with a truncated surface 58 set at an angle as shown in FIGS. 6 and 8.

A transverse bore 60 is provided through the rod 12 for receiving the truncated end portion 58 of the pin 54 therein when the anchor is in its retracted position as shown in FIG. 2.

In operation, the earth anchor 10 is configured for insertion into the ground as shown in FIGS. 1 and 2 with the anchor arms fully retracted and the skirt member, in its pleated state, being cylindrical in shape with diameter no larger than the plate members 22 and 38. The locking pin 54 is extended into the bore 60 of the anchor rod 12 with the truncated surface 58 being positioned partly into the bore 60 as shown in FIG. 6. The pointed end 43 of the housing 42 is then inserted into the ground until the auger ribbon flights 44 and 46 contact the soft earth. The handle member 14 is then utilized to force the earth anchor into the ground with a twisting motion so that the ribbon flights 44 and 46 cause the earth anchor to move downwardly into the earth while the pin member 54 prevents rotation of the rod 12 with respect to the threaded plate member 38.

After the earth anchor has been moved to the desired depth, the rod 12 is then rotated in an opposite direction, typically for less than a quarter of a turn, which causes the edge of the bore 60 of the rod 12 to force against the truncated portion 58 of the pin member 54 causing the pin member 54 to slide out of contact with the rod 12 as shown in FIG. 8.

The rod then is again rotated in its original direction, and since the pin member 54 is no longer in contact with the rod 12, the plate member 38 and associated housing 42 remain stationary, thereby threadedly receiving the rod 12 into the interior of the housing 42. It is noted at this point that after the bore 60 has passed the pin member 54 and starts moving into the housing 42, the bore 60 is no longer in alignment with the pin member 54 thereby preventing the pin member from substantially reinserting back into the bore 60.

As the threaded rod 12 is moved downwardly into the housing 42, the collar member 18 and associated flange member 20 force the plate member 22 in a downward direction with respect to the plate member 38. At this point the inside convex surface 30 of the anchor arms 34 move in sliding contact with the bevel portion 40 of the plate member 38 thereby forcing the anchor arms outwardly into the earth. As the anchor arms 24 move outwardly into the earth, they pull the skirt member 34 therealong and the lower or outer portion of the pleats in the skirt member start straightening.

When the outer ends of the anchor arms 24 first enter the undisturbed surrounding earth, they are prevented from any rotation about the rod axis. If the plate 38 then attempts to rotate due to friction in the threads, such rotation is prevented by the anti-rotation stop members 39 and 41. Throughout the entire extending operation the convex surface 30 of the anchor arms 24 move along the edges of the stop members 39 and 41 positively preventing any rotation of the plate 38 and associated housing 42.

Figure 5:
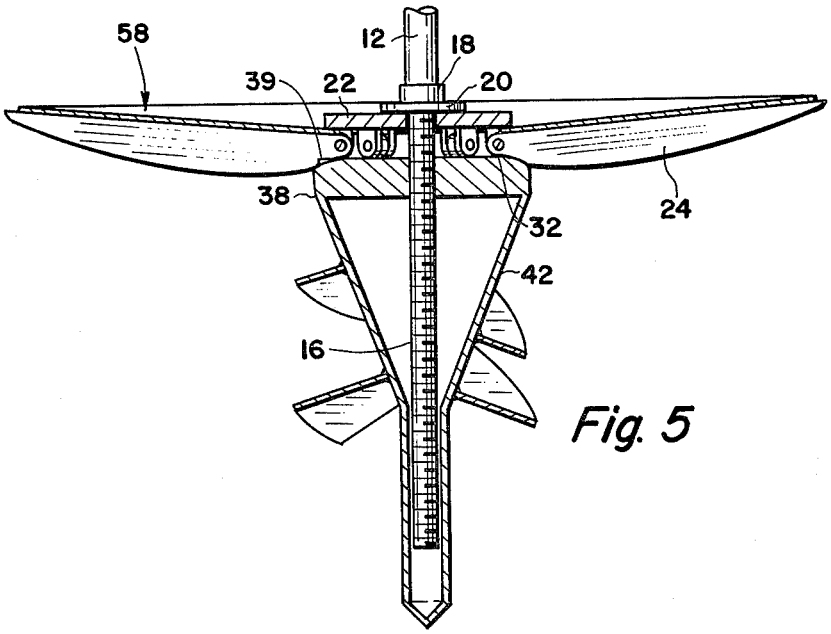
FIG. 5 is a sectional elevational view of the earth anchor of FIG. 4 taken along the broken lines 5—5 of FIG. 4.

The diameter of the skirt member 34 in its unpleated form, is configured to be substantially equal to the diameter of the outer edge 37 of the skirt member when the anchor arms 24 reach a substantially right angle position with respect to the rod 12 as shown in FIG. 5.

However the shape of the lands 32 near the inner end of the anchor arms 24 are such that when the plate members 22 and 38 are moved together, the anchor arms 24 go just past their right angle position to form a concave upper surface of the arms and associated skirt member 34 as shown in FIG. 5 and as indicated by reference character 58. It is also noted that since the upper or inner edge 36 of the skirt member extends substantially opposite the pivot pins 28, the inside edge 36 of the skirt member which is still in its pleated form even when extended is sandwiched between the plate members 22 and 38 which provides added stability and holding power to the extended skirt member when an outward or pulling force is applied to the anchor rod 12.

The portion of the threads above the plate member 38 may be coated with an anti-corrosion compound but as the rod threads move the plate 38 threads, this coating is disturbed. However, it is also noted that since the lower end of the threaded portion 16 of the rod 12 has fully extended into the housing 42 as shown in FIG. 5, it is protected from the corrosive nature of the soil into which the anchor has been inserted.

It is further noted that without further rotation of the rod 12, the anchor is locked in its extended position and cannot be inadvertently unlocked without positive rotation of the rod 12.

If it is desired to remove the anchor from the earth, the rod 12 is rotated in a way such that the collar member 18 and associated flange members 20 are moved upwardly with the rod 12 thereby no longer forcing the plate member 22 toward the plate member 38.

It if becomes difficult or impossible to remove the anchor from the earth, the rod 12 may be continually rotated until it dislodges from the plate 38 and the rod 12 may then be simply pulled from the earth.

Figure 9:
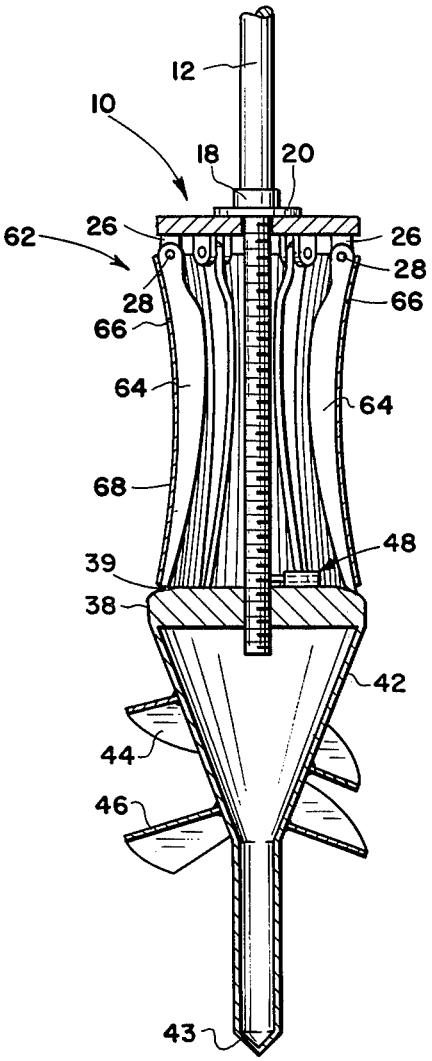
FIG. 9 is a sectional elevational view of a second embodiment of the earth anchor wherein the outer surface of the arcuate arms and associated skirt member are provided with a concave arcuate shape.

Referring now to FIG. 9, reference character 62 generally indicates a second embodiment of the earth anchor which operates in a substantially identical manner to that of the earth anchor 10.

However in this case, anchor arms 64 are provided with an arcuate outer concave shape 66 and are provided with a shaped pleated skirt member 68.

Figure 10:
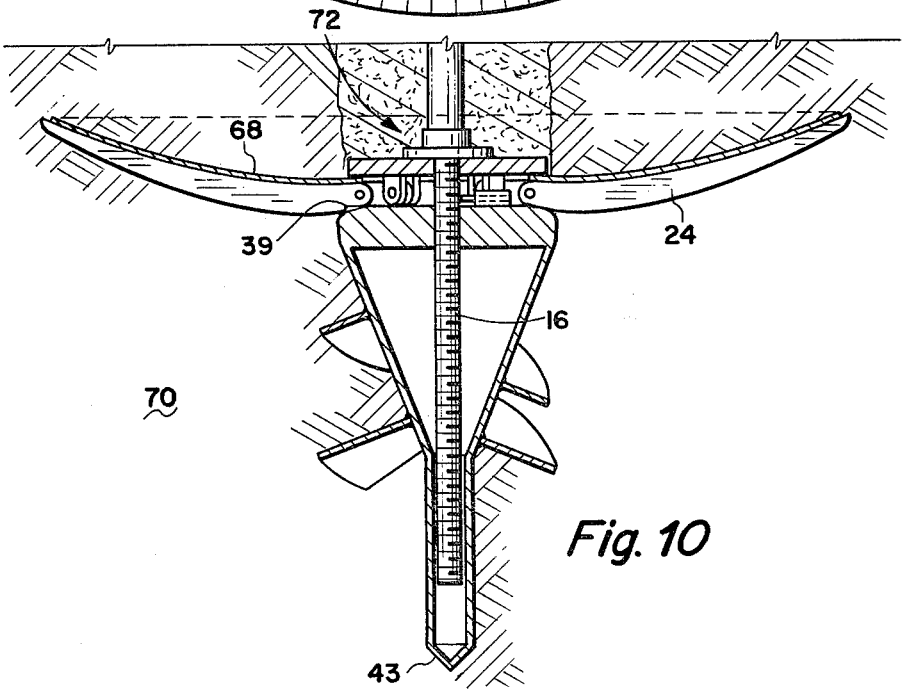
FIG. 10 is a sectional elevational view of the embodiment of FIG. 9 shown in an expanded position.

The shape of the arcuate anchor arms 66 and associated skirt member 68 will provide for easier expansion after the anchor has been lowered into the earth to its desired distance as shown in FIG. 10. It can be seen that as the anchor arms 64 are being extended into the undisturbed earth indicated by reference character 70, the curved configuration of the anchor arms will cause the anchor arms and associated skirt member to more accurately move through the curved path created by the outer ends of the anchor arms as they are moving downwardly and outwardly during the expanding operation.

It can be seen in FIG. 10 that after the earth anchor has been fully inserted into the ground and the arms thereof expanded, that the outer surface of the skirt member 68 is in contact with undisturbed earth, the only substantial earth disturbance being directly above the center part of the anchor mechanism which was created when the device was augered into the earth and as generally shown by reference character 72.

Figure 11:
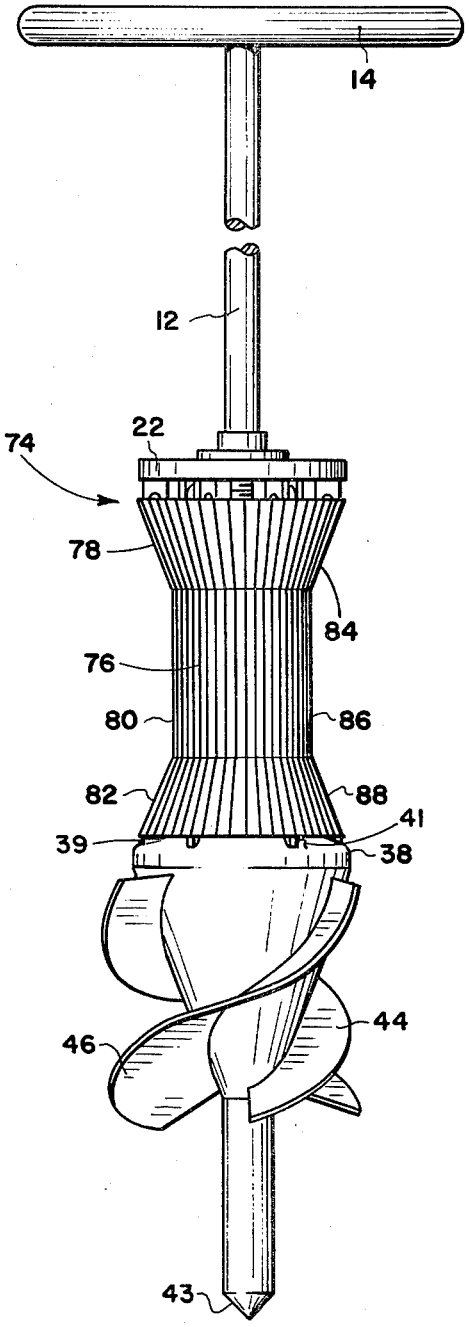
FIG. 11 is an elevational view of the third embodiment of the invention showing a modification of the concave arcuate arms.
Figure 12:
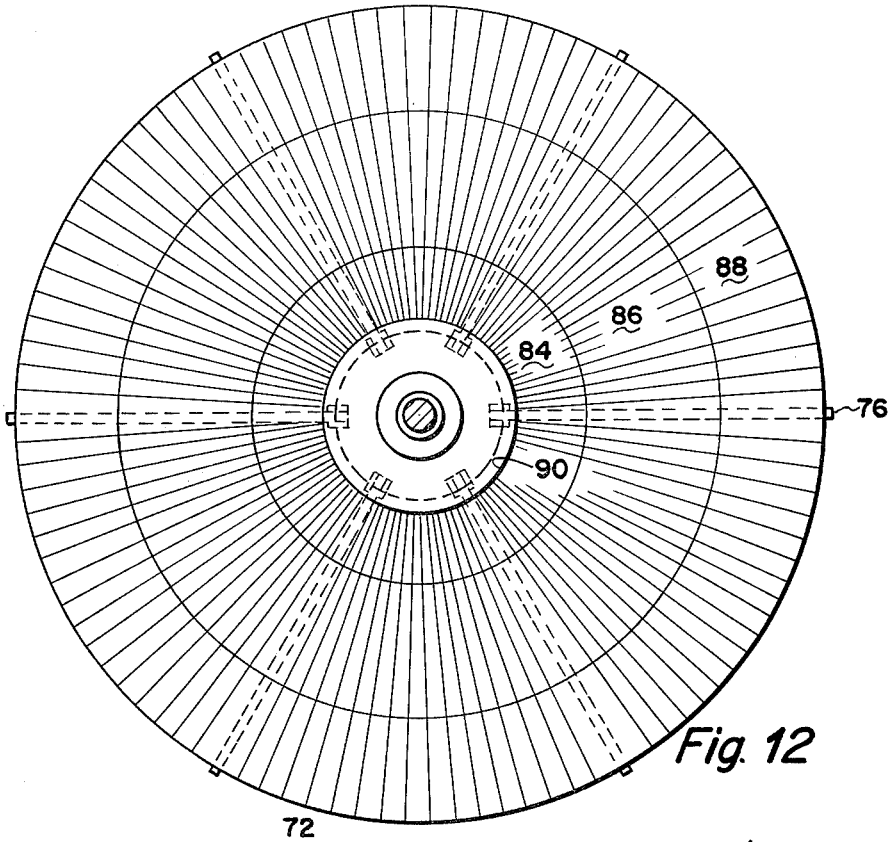
FIG. 12 is a plan view of the embodiment of FIG. 11 in an expanded position.

Referring now to FIGS. 11 and 12, reference character 74 generally indicates a modification of the embodiment 62 having anchor arm members 76, the outer edge thereof being concave by virtue of three straight segment portions 78, 80 and 82. The embodiment 72 is provided with pleated skirt segments 84, 86 and 88 which are secured to the outer surface edge of the anchor arm segments 78, 80 and 82, respectively.

The configuration of the anchor arm 74 provides substantially the same benefit as that of 62 in that as the anchor arms are being extended into the earth, they follow a curvelinear path resulting in a minimal disturbance of the earth and less resistance to the expanding force.

FIG. 12 depicts the anchor arms 76 and associated skirt segments 84, 86 and 88 in a fully expanded position. It is also noted that the inner edge 90 of the skirt segment 84, in its expanded position, is sandwiched between upper and lower plate members 22 and 38.

The portions of the embodiments described in FIGS. 9 through 12 which are common to the embodiments shown in FIGS. 1 through 8 carry the same reference character numbers for purposes of simplicity.

From the foregoing it is apparent that the present invention provides an earth anchor which is particularly suitable for anchoring objects in sand and soft earth such as marshlands, swamps and the like.

Whereas, the present invention has been described in particular relation to the drawings attached hereto, other and further modifications apart from those shown or suggested herein may be made within the spirit and scope of the invention.

What is claimed is:

1. An earth anchor for securing objects in soft earth comprising:

(a) an elongated anchor rod having inner and outer ends, an inner end portion threaded over at least a certain length;

(b) a first plate member slidably carried by the rod and including means cooperating between the first plate member and the rod to prevent movement of the first plate member outwardly along the rod past a certain point;

(c) a plurality of extendable anchor arm members having inner and outer surfaces, each anchor arm member being pivotally carried by the inner surface of the first plate member;

(d) a second plate member threadably carried by the inner end portion of the rod and operably engagable with the anchor arm members for extending the anchor arm members into the earth upon rotation of the rod with respect to the second plate member; and (e) a single flexible metal skirt member secured to the outer surface of the anchor arm members such that when the anchor arm members are extended into the earth, the skirt member is spread over the outer surface of the extended anchor arms to provide an enlarged retaining surface, the inner edge of the skirt member being firmly supported between the first and second plate members.

2. An earth anchor as set forth in claim 1 wherein the skirt is of a pleated cylindrical shape, the diameter of which in the pleated form is no greater than the diameter of the first and second plate members.

3. An earth anchor as set forth in claim 2 wherein the circumference of the cylindrical skirt is substantially equal to the circumference of the outer edge of the skirt member in an extended position of approximately 90° with respect to the anchor rod.

4. An earth anchor as set forth in claim 3 wherein the anchor arms are fully extended at a position beyond 90° from the threaded portion of the rod.

5. An earth anchor as set forth in claim 1 and including a housing means carried by the second plate member in communication with the inner surface thereof and being of sufficient size to fully receive the threaded portion of the rod therein.

6. An earth anchor as set forth in claim 5 wherein the housing is tapered inwardly from the peripheral edge of the second plate member and terminating substantially in a point.

7. An earth anchor as set forth in claim 6 and including at least one ribbon flight auger around the outer periphery of the housing, a locking means for locking the second plate member with respect to the rod for the purpose of rotating the anchor into the earth, said locking means including means to disengage the locking means after rotating the anchor into the ground and before expanding the anchor arm members.

8. An earth anchor as set forth in claim 7 wherein the locking means comprises a slidable pin carried by the second plate member and a transverse bore in the anchor rod in alignment with said pin when the arm members are in a retracted position and wherein the means for disengaging the pin includes a truncated end surface of the pin being at an angle, said truncated end surface being biased to prevent independent rotation of the second plate and the anchor rod in a first direction and to slide out of engagement with the bore when the rod is rotated in an opposite direction.

9. An earth anchor as set forth in claim 1 and including at least one anti-rotation stop member carried by the second plate member and engageable with at least one of the anchor arm members to prevent rotation of said second plate member with respect to the anchor arms.

* * * * *